United States Patent [19]

Derouane et al.

[11] Patent Number: 4,578,181

[45] Date of Patent: Mar. 25, 1986

[54] HYDROTHERMAL CONVERSION OF HEAVY OILS AND RESIDUA WITH HIGHLY DISPERSED CATALYSTS

[75] Inventors: Eric G. Derouane, Hopewell, N.J.; Philip Varghese, Newtown, Pa.

[73] Assignee: Mobil Oil Corporation, New York, N.Y.

[21] Appl. No.: 624,304

[22] Filed: Jun. 25, 1984

[51] Int. Cl.[4] ..... C10G 47/06; C10G 47/12; C10G 47/20; C10G 11/06

[52] U.S. Cl. ..... 208/110; 208/111; 208/112; 208/114; 208/120; 208/121

[58] Field of Search ..... 208/112, 114, 120, 121, 208/58, 59, 61, 110, 111

[56] References Cited

U.S. PATENT DOCUMENTS 3,796,671 3/1974 Gleim ..... 208/114

3,893,943 7/1975 Willard, Sr. ..... 502/168

4,352,729 10/1982 Jacquin et al. ..... 208/209

*Primary Examiner*—John Doll

*Assistant Examiner*—O. Chaudhuri

*Attorney, Agent, or Firm*—Alexander J. McKillop; Michael G. Gilman; James F. Powers, Jr.

[57] ABSTRACT

A process of preparing a highly dispersed (colloidal or submicron size) heterogeneous catalyst for the hydrothermal conversion of heavy oils and residua is described. The process comprises preparing a reverse micellar dispersion by mixing water, an organic solvent, and an ionic or neutral surfactant to which is added an aqueous solution of a metal salt. The metal salt is reduced to a colloidal dispersion of the catalyst in a mixed water-organic liquid phase. The colloidal catalyst is then blended into resid or heavy oil fractions, and the blend is treated under hydrothermal conditions.

23 Claims, 4 Drawing Figures

HYDROTHERMAL CONVERSION OF HEAVY OILS AND RESIDUA WITH HIGHLY DISPERSED CATALYSTS

BACKGROUND OF THE INVENTION

This invention relates to catalytic conversion of heavy, hydrogen-deficient, high metals content feedstocks to lower boiling liquids. It particularly relates to highly dispersed hydrogenating and/or cracking catalysts and methods for preparation thereof.

A great demand continues for refinery products, particularly gasoline, fuel oils, and gaseous fuels. Because of the shortage and cost of high quality petroleum-type feedstocks, the refiner now must obtain increased conversions of the heavier, more hydrogen-deficient, high impurity-containing portions of petroleum type feedstocks. Included in this category are heavy vacuum gas oils, atmospheric residua, vacuum tower bottoms, and even syncrudes derived from coal, oil shale, and tar sands.

In some cases, high levels of nitrogen and sulfur constitute a serious problem in such refractory, high molecular weight material, particularly with reference to downstream processing and environmental and pollution limitations associated with the products. An even more difficult problem is posed by the presence of metallic impurities, such as nickel, vanadium, iron, etc. in heavy petroleum fractions. Such metals, commonly associated with porphyrin rings and asphaltenes in high molecular weight cuts, can cause serious engineering-/hardware problems in catalytic cracking. As a catalyst is exposed to repeated cycles of reaction/regeneration in a fluid catalytic cracker (FCC), these metals are adsorbed and tend to build up with time and accumulate on the catalyst. They then cause dehydrogenation-type reactions, resulting in formation of very large amounts of coke and large amounts of $H_2$ gas which may put a severe strain on the FCC unit regenerator air blower and the wet gas compressor capacity. Further, and very important, their presence is often associated with a serious loss of conversion and gasoline yield.

Particularly because such residual fractions can contain high percentages of heteroatoms and metals which do not easily allow processing in catalytic units, obtaining maximum conversion of atmospheric and vacuum residue fractions to higher value premium distillate liquids is a continuing challenge. To avoid the aforesaid difficulties with catalytic cracking in the presence of these heteroatoms and metals, the major conversion processes have been delayed coking and fluid coking of these feedstocks.

In coking processes, thermally induced cracking not only produces lower boiling liquids but also produces high amounts of gas and coke byproducts because of the uncontrolled nature of the thermal reactions. Improvements in the yield pattern can be affected by hydrotreating the coker feed prior to thermal reaction, but this approach is limited by the poor metal tolerance of conventional hydrotreating catalysts.

A single-step process that can achieve substantial conversion of residua and similar hydrogen-deficient, high impurity-containing cracking feedstocks to lower boiling liquids while minimizing coke yields and producing more high quality liquids having low metal and heteroatom contents, so that these high quality liquids can be conventionally processed in fluid catalytic crackers, would be highly advantageous. Many methods have been proposed for doing so, and it has been found that highly dispersed metals such as Mo, Ni, and Fe, which have hydrogenating activity in their sulfided state, are most effective as means to control thermally induced reactions that take place in a homogeneous phase at high temperature. In fact, when the catalytic metal is initially present as a soluble compound, a limiting and very high catalytic effectiveness is reached which allows as little as 200 ppm of metal to achieve maximum control of the thermal conversions. This result requires, however, that an oil-soluble organometallic catalyst precursor be used. Examples of such compounds include naphthenates, pentanedionates, octoates, and acetates of metals such as Mo, Co, W, Fe, and V. Such metal-organic compounds are, however, expensive, relative to the water-soluble inorganic salts in which such metals are commonly found in nature.

U.S. Pat. Nos. 1,369,013 and 1,378,338 relate to oil-dispersed catalysts which are typically a compound of a catalytic metal united to a very weak, organic acid in an oil, such as nickel oleate. The metal-organic compound, soluble in oil, may be reduced with hydrogen or decomposed by heat to form an "oilcolloid" in a state of almost infinite subdivision.

U.S. Pat. No. 2,076,794 describes oil-dispersed catalysts which are emulsified by non-toxic emulsifying agents, such as a sodium salt of oleanolic acid ursolic acid, or other sapogenin.

U.S. Pat. No. 3,622,497 discloses a catalytic slurry process for hydrofining resids. The catalyst is unsupported and is colloidally dispersed vanadium sulfide, such as tetravalent vanadium salts which are prepared in a phenolic solution that decomposes under operational conditions to form catalytic vanadium sulfide, the ratio of sulfur to vanadium being nonstoichiometric, at a ratio of 0.8:1 to 1.8:1. The solution is non-aqueous, the tetravalent vanadium salt being dissolved in a phenol or phenolic mixture, preferably coal tar or wood tar, containing large amounts of catechol and various pyrogallol derivatives. This solution is then mixed with a charge stock, and the mixture is commingled with hydrogen, heated, and reacted at temperatures of 225°–500° C. and at pressures of 500–5000 psig.

U.S. Pat. No. 4,149,992 describes a dispersion wherein a phosphorus-vanadium-oxygen catalyst is mixed and then heated to evaporate the water and form a putty which is extruded and then dried and calcined.

U.S. Pat. No. 4,252,671 discloses a method for preparing a homogeneous, physically stable dispersion of colloidal iron particles by preparing a solution of an active polymer in an inert solvent and incrementally adding thereto an iron precursor at a temperature at which the iron precursor becomes bound to the active polymer and thermally decomposes to produce elemental iron particles in an inert atmosphere. A polymer solution can be prepared from copoly(styrene/4-vinylpyridine) and water-free o-dichlorobenzene at room temperature. Iron pentacarbonyl is added in increments during very gradual heating until the iron pentacarbonyl is completely decomposed to form a dispersion after cooling at room temperature and under an inert atmosphere.

U.S. Pat. No. 4,252,677 describes a method for preparing homogeneous colloidal elemental dispersions of a catalyst in a non-aqueous fluid. A colloidal dispersion of nickel particles can be prepared with a hydroxyl-terminated copoly(styrene/butadiene) as the functional polymer. Using a similar dispersion of palladium particles, the polymer solution of copoly (styrene/4-vinylpyridine) can be formed by dissolving the copolymer in diethyleneglycoldimethyl ether.

Going beyond these patented processes, there nevertheless exists a need for a process of preparing a highly dispersed heterogeneous catalyst, which is colloidal or submicron in size, for the hydrothermal conversion of heavy oils and residua that can obviate the expense and processing difficulties associated with using organic reactants and that can incorporate the desired catalytic metals in their inorganic form.

SUMMARY OF THE INVENTION

The object of the invention is to provide a process for preparing a highly dispersed heterogeneous catalyst, having colloidal or submicron sized particles, from common water-soluble inorganic salts and other simple materials.

Another object is to provide a process for mixing this highly dispersed heterogeneous catalyst with heavy feedstocks.

An additional object is to provide a process for reacting this mixture of heavy feedstocks and highly dispersed heterogeneous catalyst to provide higher value premium distillate liquids that are suitable for catalytic cracking by conventional methods.

A process for preparing a highly dispersed heterogeneous catalyst having colloidal or submicron sized particles from common water-soluble inorganic salts and for mixing this catalyst with heavy feedstocks and hydrothermally converting the heavy oil and residua is provided according to the principles and the foregoing objects of this invention.

The process of this invention comprises the following steps:

A. preparing a reversed (inversed) micellar dispersion of water in an organic solvent by proper mixing of water with the organic solvent in the presence of an ionic or neutral surfactant;
B. admixing an aqueous solution of an inorganic salt of a selected metal catalytic component in the micellar dispersion while maintaining the composition of the system and the stability domain for reverse micelles and achieving a metal ion concentration of 0–1 molar with respect to the total amount of water present in the dispersion;
C. preparing the colloidal catalyst by reacting the dissolved metal ions with a precipitating or reducing reagent;
D. blending the colloidal catalyst into the heavy oil fraction in concentrations of up to 10% water on oil;
E. removing the organic solvent and recycling it to step A;
F. treating the mixture of heavy oil fractions and colloidal catalysts under hydrogen pressure at conditions where normal conversion takes place; and
G. separating the effluent into the desired product fractions.

Typical compositions for preparing the reversed micelle of Step A comprise ternary systems in the following range: water, 0–20 wt. %, organic solvent, 50–90 wt. %, and a surfactant 1–25 wt. %. For instance, a reverse micellar dispersion containing the catalytic metal in aqueous solution according to step B can be prepared by mixing 4 wt. % water with 80 wt. % hexanol and 10 wt. % cetyl-trimethyl-ammoniumbromide (CTAB) to which is added an aqueous solution of the metal, amounting to 6 wt. % of the total mixture. The metal salt in the dispersion of step B can be reduced to the metallic state or it can be converted into a catalytically active compound of the metal by a variety of treatments, leading to a colloidal dispersion of the catalyst in the mixed water-organic phase.

DETAILED DESCRIPTION OF THE INVENTION

Figure 2:
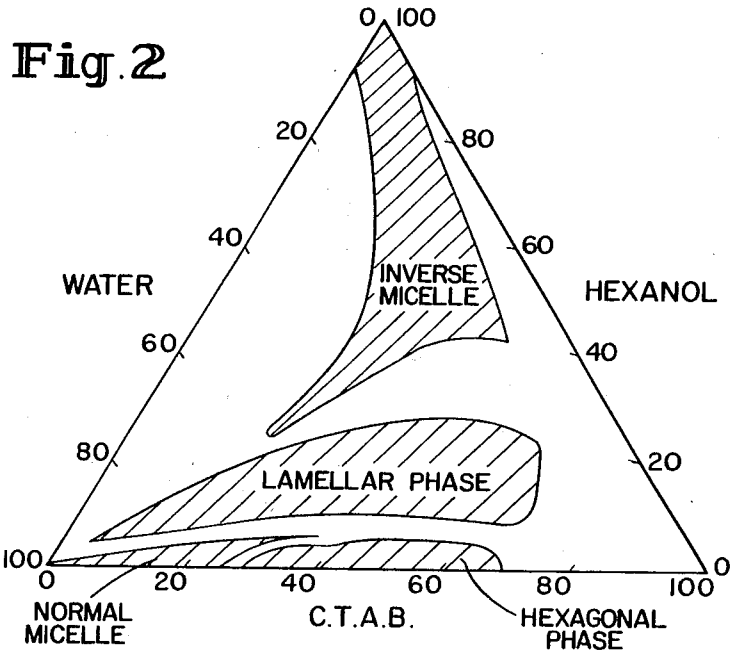
FIGS. 2 and 4 are phase diagrams illustrating the stability domains of micellar dispersions in a particular water-oil-surfactant ternary system.
Figure 3:
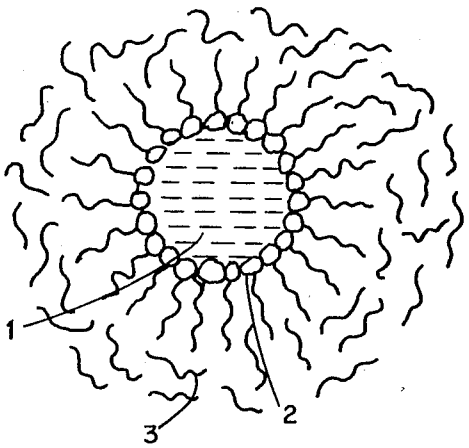
FIG. 3 is a schematic view of the inverse micelle phase.

Ternary systems consisting of water, an organic component, and a surfactant can lead to various phases which are characterized by the relative arrangement of the water and organic molecules. As an example, FIG. 2 illustrates the stability domains of these phases as observed in the Water - Hexanol - Cetyl-trimethylammonium bromide (CTAB) system. Spherical reversed (inversed) micellar dispersions (also called microemulsions) are formed at low concentration of water and surfactant as shown in the phase diagram. The inversed micelles consist (FIG. 3) of a water core 1 with typical diameter less than 10 nm, surrounded by an interfacial film 2 containing surfactant and organic molecules. These spherical entities are dispersed in the organic continuous medium 3.

Figure 4:
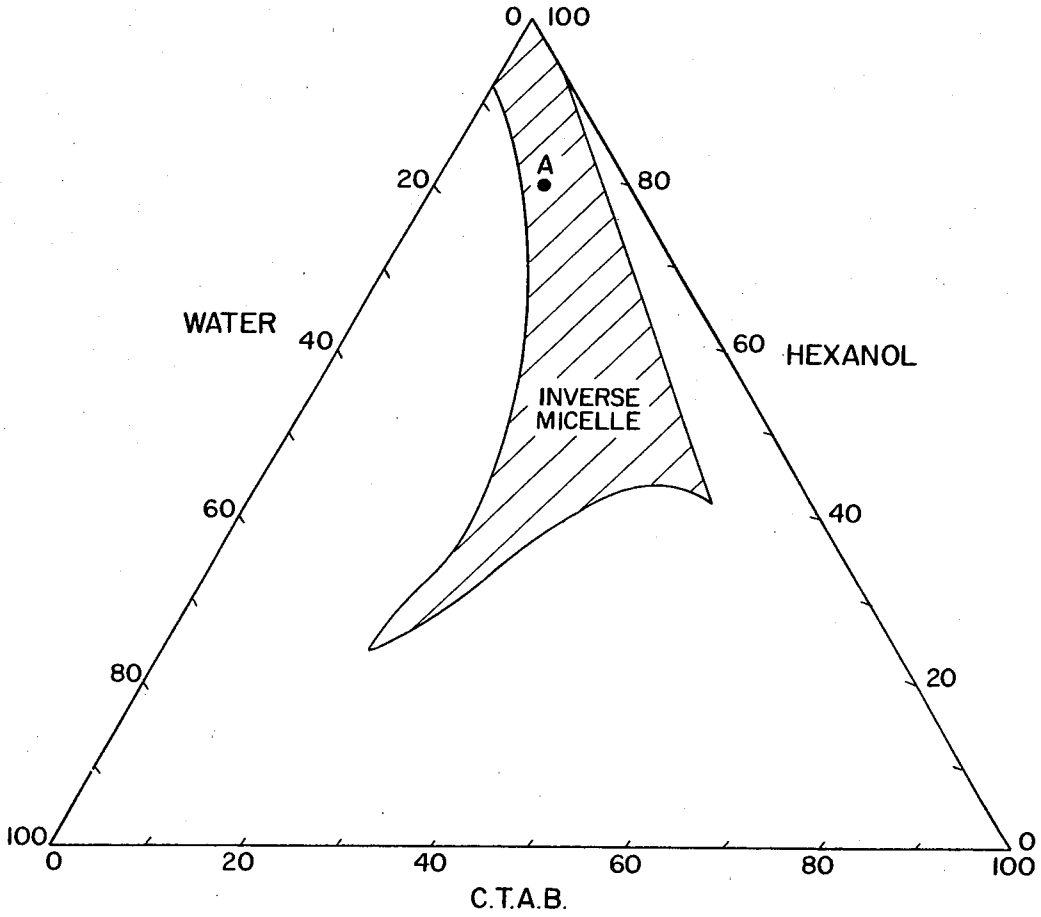

The stability domain of inverse micelles is defined as the range of compositions, in the phase diagram (FIG. 2), where such structures exist. In the present invention, the amount of water is the sum of the initial water addition plus the water in the catalytic metal salt solution. In a typical preparation, water, hexanol, and CTAB are mixed together to achieve a composition falling into the stability domain of the inversed micelle, as illustrated in FIGS. 2 and 4. The metal salt is then introduced as its aqueous solution in such a way that the amount of water added does not displace the characteristic system composition to a point outside of the stability domain for inverse micelles. The concentration of the metal salt in its solution should be in the range of $10^{-3}$ molar, its value being dictated by the amount of catalytic component which is desired.

Organic components which are used to form the inverse micelles are generally long chain alcohols ($C_6$–$C_{10}$), functioning as solvent for one end of the surfactant. It is, however, also possible to use other organics such as hydrocarbons. Water is a necessary ingredient, both as a component of the ternary system and as a solvent for the inorganic metal salt(s) to be dispersed. Surfactants include any anionic, cationic, neutral, and polar detergents possessing tensioactive properties. Preferentially, these will be long chain tertiary amines, quaternary ammonium or sulfonate or carboxylate salts, polyether ester, and alkyl-aryl polyether alcohols.

The broad, intermediate, and narrow ranges of weight percentages suitable for the components of the catalysts of this invention are shown in Table I.

TABLE I

| | Broad | Intermediate | Narrow | Specific |
|---|---|---|---|---|
| Water | 1–20 | 1–15 | 1–10 | 4 |
| Organic solvent | 50–90 | 70–90 | 75–85 | 80 |

TABLE I-continued

| | Broad | Intermediate | Narrow | Specific |
|---|---|---|---|---|
| Surfactant | 1-25 | 1-15 | 5-15 | 10 |
| Salt solution | 1-10 | 1-10 | 4-8 | 6 |

Compositions for specific ternary system will be dictated by the applicable ternary phase diagram. FIGS. 2 and 4 are illustrative of the water - hexanol - CTAB system; the specific composition in the last column of Table 1 is represented as A in FIG. 4 as it applies to that particular system. Changing the relative amounts of water, hexanol, and CTAB varies the size of the aqueous micellar cores which affects in turn the size of the catalyst particles eventually formed.

The metal salt or salts dissolved in the inversed micelles can be converted into catalytically active components for hydrotreatment by a variety of means. For example, the metal ions can be reduced to the metallic form using either hydrogen, hydrazine, or sodium borohydride as reducing agent; in this way, chloroplatinic acid is reduced to platinum metal colloidal particles. Treatment with sodium borohydride can be used to convert salts such as nickel and iron chlorides to the corresponding borides. Hydrogen sulfide may be employed to precipitate colloidal sulfides from, as examples, cadmium chloride or ammonium molybdate micellar solutions. Other means of converting the metal salts to more active highly dispersed entities need not be ruled out. Similarly, a possible application which involves the deposition of these highly dispersed catalytic particles (Pt, $MoS_2$, Ni boride, and the like . . . ) on solid supports such as aluminosilicates, clays, alumina, or silica, prior to their use in the conversion step, should also not be ruled out. Typical hydrotreating metals include vanadium, chromium, molybdenum, tungsten, iron, cobalt, nickel palladium, platinum, and cadmium.

Additional catalytic functionality, such as acid activity, may also be included by using acidic solids such as aluminas, clays, amorphous or crystalline alumino-silicates, or other oxides and mixed oxides which are known in the art to have catalytic acid activity. Such acid activity may also be either dispersed or entrained in the feed or, alternatively, it may be present as a fixed or ebullient (fluidized) bed over which the feed is passed.

The processing temperature for hydrotreating heavy feedstocks may range from 700° F. to 950° F. but is preferably 750°-870° F. Hydrogen pressures in the range of 1000-2000 psig and residence times from 6 minutes to 120 minutes may be employed. The liquid products may be treated in a variety of ways that include filtration to remove solids or distillation or solvent extraction or centrifugation to concentrate and remove solid impurities in a minor drag stream. The solid stream then derived or any fraction thereof that is rich in catalytic metal may be recycled for use in the reaction. Any fraction of the resultant liquids that requires further conversion may be hydrotreated and then hydrocracked or blended into an FCC feed. Alternately it may be conventionally recycled to reaction in this process.

Figure 1:
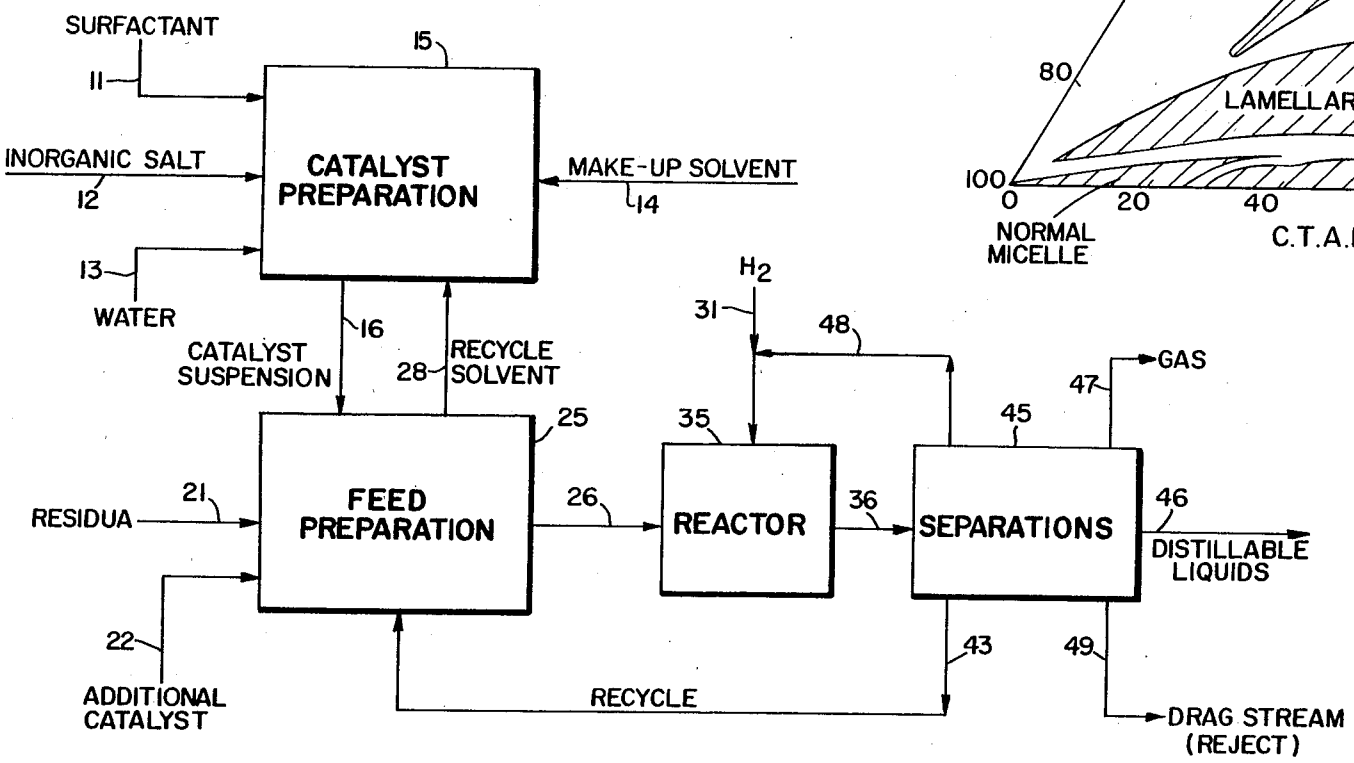
FIG. 1 is a schematic flow sheet illustrating the steps of the preferred process.

The schematic flow sheet shown in FIG. 1, which illustrates catalyst preparation and resid conversion, shows a surfactant stream 11, an inorganic salt stream 12, a water stream 13, a makeup solvent stream 14, and a recycle solvent stream 28 entering catalyst preparation zone 15 which produces a catalyst suspension stream 16 which is fed to feed preparation zone 25. A hydrocarbon residua stream 21, a recycle stream 43, and a stream of additional cataylst 22 are also fed into feed preparation zone 25. The product of this zone is an admixture of residua and catalyst suspension which leaves as stream 26 to become feed to reactor 35 into which a hydrogen recycle stream 48 and a hydrogen makeup stream 31 are also fed. The reacted mixture stream 36 enters separator 45 from which the hydrogen recycle stream 48, a gas product stream 47, a liquid product stream 46, a drag or reject stream 49, and the recycle stream 43 are removed. This continuous process controls the reaction that takes place in a homogeneous environment within reactor 35.

The highly dispersed heterogeneous catalyst, which is in a colloidal state or is at least submicron in size, is formed as a reversed micellar dispersion within catalyst preparation zone 15. Specifically, reduction of the metal salt to a colloidal dispersion of the catalyst in a mixed water-organic liquid phase is performed within zone 15 in order to produce the colloidal catalyst which is then blended with residua stream 21 within feed preparation zone 25. The resid conversion reaction takes place within reactor 35 under hydrothermal conditions, whereby the materials exist as a liquid in the presence of steam and separate, as by flashing and simple fractionation, within separator 45. Reactor 35 may include a fixed or ebullated bed of solid such as coke, carbon, alumina, silica, silica-alumina or clay.

EXAMPLES 1-4

The following four examples give results for autoclave conversion of a Boscan (933° F.+) resid at 840° F. for 60 minutes in a one-liter autoclave at 1000 psig of gas pressure, with no catalyst and with the same amount of a molybdenum catalyst prepared by three different methods. The data are shown in Table 2. These data are primarily directed at demonstrating that highly dispersed metals generated as per the invention can perform in a fashion comparable to the performance of catalysts derived from more expensive organometallic compounds.

EXAMPLE 1

Boscan vacuum (933° F.+) resid was coked without hydrogen and under 1000 psig of helium for 60 minutes at 840° F., representing high thermal severity. The results in Table 2 show that 42.5% of coke and 20.5% of $C_4$ gases, representing $C_1$-$C_4$ products of the reaction, were produced.

EXAMPLE 2

The same Boscan resid, admixed with 190 ppm of molybdenum derived from an oil soluble organometallic compound (naphthenate), was similarly treated in the one liter autoclave under 1000 psig of hydrogen for 60 minutes at 840° F. This catalyst represents the optimum oil-dispersed catalyst known to the prior art. The results shown in the table indicate that much less coke, $C_4$ gases, and $C_5$-400° F. product were produced, while the quantities of 400°-800° F. product and of 800°-1000° F. and 1000° F.+ liquids were markedly increased.

EXAMPLE 3

Another sample of the Boscan resid was autoclaved under 1000 psig of hydrogen with 190 ppm of molybdenum, derived from a water soluble but oil-insoluble inorganic Mo salt (ammonium heptamolybdate). The results in Table 2 show an increased production of coke, as compared to the moly-naphthenate run of Example 2, an increased production of the higher boiling liquids, about the same amounts of $C_5$-400° F. product and 400°-800° F. product, and a slightly increased amount of $C_4$ gases.

EXAMPLE 4

An additional sample of the Boscan resid was autoclaved under 1000 psig of hydrogen with 190 ppm of molybdenum sulfide in highly dispersed form which had been prepared from a water-soluble salt according to the method of this invention. The results in the table indicate that the production of coke was only slightly more than the naphthenate run of Example 2 and that the same amount of 1000° F.+ liquids, a much smaller amount of 800°-1000° F. product, the same amount of 400°-800° F. product, an increased amount of $C_5$-400° F. product, and even less $C_4$ gases were produced, as compared to the naphthenate run. The amount of $C_5$-400° F. product is even better than the thermal cracking results of Example 1.

The highly dispersed molybdenum sulfide catalyst used in Example 4 was prepared by bubbling hydrogen sulfide in a mixture of water, hexanol, CTAB, and a molybdenum salt as ammonium molybdate. The heat required to flash off the water and hexanol used to convey the colloidally dispersed Mo into reaction was provided in the autoclave itself.

The coke was analyzed and found to include greater than 85% of the metals that were associated with the porphyrins and asphaltenes in the Boscan resid. This coke, in a continuous process operated according to FIG. 1 and using the catalyst and resid of Example 4, would leave as a part of drag stream 49, consisting of some of the 1000° F.+ liquids and the coke as a slurry. The three lighter liquid products (namely, the $C_5$-400° F. product, the 400°-800° F. product, and the 800°-1000° F. product) would leave as stream 46 to be separated in a distillation column, with the 400°-1000° F. liquids being sent to the catalytic cracker and the $C_5$-400° F. product being sent to a reforming operation or blended with other gasoline products. The $C_4$ gases would leave as gas stream 47, and unused hydrogen would leave as hydrogen stream 48. The remaining half of the 1000° F.+ liquids would be recycled as recycle stream 43 to the feed preparation zone 25.

TABLE 2

| Autoclave Conversion of a Boscan (933° F.) Resid for 840° F., 60 mins. | | | | |
|---|---|---|---|---|
| Examples | 1 | 2 | 3 | 4 |
| Gas | 1000 psig He | 1000 psig $H_2$ | 1000 psig $H_2$ | 1000 psig $H_2$ |
| Catalyst Source | None | 190 ppm Mo Naphthenate | 190 ppm Mo Ammonium Molybdate | 190 ppm Mo Inversed Micelle (prepared from ammonium molybdate) |
| $C_4^-$ Gases | 20.5 | 13.7 | 16.3 | 11.7 |
| $C_5$-400° F. | 19.0 | 13.9 | 13.5 | 20.3 |
| 400-800° F. | 11.2 | 24.8 | 23.2 | 23.3 |
| 800-1000° F. | 3.1 | 9.0 | 7.1 | 4.0 |
| 1000° F.+ Liquids | 3.7 | 15.2 | 8.7 | 15.5 |
| Coke | 42.5 | 23.4 | 31.8 | 25.2 |

It should be noted that inverse micelle catalysts of this invention can be admixed with the resid or other heavy oil before or after reduction. For example, the hydrogen added to reaction zone 25 is very effective for reducing the catalyst under the high temperature reaction conditions. However, when sodium borohydride or hydrazine, for example, is the reducing agent, it is generally preferred that the reduction step be done before admixture with the heavy oil or resid.

Alternatively, the inverse micelle dispersion can be admixed with finely powdered clay, alumina, or amorphous or crystalline aluminosilicate, such as zeolite in its initial stage of preparation. Any of these acidic solids should be as finely dispersed as possible. When precipitation/reduction occurs, the colloidal clusters of metals then readily deposit upon much larger particles of solid material.

What is claimed is:

1. A process for catalytically converting a heavy hydrocarbon feedstock to lower boiling liquids, comprising:

preparing a colloidal dispersion of a metal catalyst in a mixed water-organic liquid phase by admixing an effective amount of an aqueous salt solution of a metal with an inverse micellar dispersion of said mixed water-organic liquid phase and reducing or precipitating said metal salt to an elemental metal or metal compound; and contacting said feedstock with said colloidal dispersion in the presence of hydrogen and at a temperature necessary to effect said catalytic conversion.

2. The process of claim 1, wherein said catalyst comprises a metal selected from the group consisting of vanadium, chromium, molybdenum, tungsten, iron, cobalt, nickel, palladium, platinum, and cadmium.

3. The process of claim 1, wherein said metal salt is contacted with a borohydride to precipitate a colloidal metal boride catalyst.

4. The process of claim 1, wherein said metal salt is contacted with hydrogen sulfide to precipitate a colloidal metal sulfide catalyst.

5. The process of claim 1, wherein said metal catalyst is deposited, after preparation of said colloidal dispersion, on a solid support selected from the group consisting of aluminosilicates, clays, alumina, and silica.

6. The process of claim 1, wherein said metal salt is reduced to an elemental metal.

7. The process of claim 6, wherein said metal salt is reduced by a reducing agent selected from the group consisting of hydrogen, hydrazine, and sodium borohydride.

8. The process of claim 1, wherein said inverse micelle comprises water, an organic solvent, and a surfactant.

9. The process of claim 8, wherein said organic solvent is a long chain alcohol having 6 to 10 carbon atoms.

10. The process of claim 9, wherein said organic solvent is hexanol.

11. The process of claim 10, wherein said surfactant is selected from the group consisting of anionic, cationic, neutral, and polar detergents possessing tensioactive properties.

12. The process of claim 11, wherein said surfactant is selected from the group consisting of long chain tertiary amines, quaternary ammonium salts, quarternary carboxylate salts, quarternary sulfonate salts, polyether esters, and alkylaryl polyether alcohols.

13. The process of claim 12, wherein said surfactant is cetyl-trimethylammonium bromide.

14. The process of claim 11, wherein said metal salt is present in said colloidal dispersion at a metal ion concentration of up to about 1.0 molar in the total amount of said water.

15. The process of claim 14, wherein said colloidal dispersion comprises 1–30 percent of said water, 1–25 percent of said surfactant, and 50–90 percent of said organic solvent.

16. The process of claim 15, wherein said colloidal dispersion comprises 1–25 percent of said water, 1–15 percent of said surfactant, and 70–90 percent of said organic solvent.

17. The process of claim 16, wherein said colloidal dispersion comprises 5–18 percent of said water, 5–15 percent of said surfactant, and 75–85 percent of said organic solvent.

18. The process of claim 17, wherein said colloidal dispersion comprises 10 percent of said water, 10 percent of said surfactant, and 80 percent of said organic solvent.

19. The process of claim 1, wherein said heavy oil is further contacted with a catalyst having acid activity.

20. The process of claim 1, wherein said colloidal metal catalyst is blended with said heavy oil in amounts of about 10 ppm to 500 ppm by weight.

21. The process of claim 1, wherein reaction of said colloidal dispersion with heavy oil is carried out in a fixed or ebullated bed of solid selected from the group consisting of coke, carbon, alumina, silica, silica alumina, and clay.

22. The process of claim 1, wherein said feedstock is contacted with said colloidal dispersion in the presence of hydrogen at pressures in the range of 1,000–2,000 psig, temperatures in the range of 700° to 950° F. and for a time of from 6 minutes to 120 minutes.

23. The process according to claim 22, wherein said temperature is in the range of from 750° to 870° F.

* * * * *